US007195259B2

(12) United States Patent
Gang

(10) Patent No.: US 7,195,259 B2
(45) Date of Patent: Mar. 27, 2007

(54) SKATEBOARD WITH DIRECTION-CASTER

(75) Inventor: Singi Gang, Choongju-shi (KR)

(73) Assignee: Slovie Co., Ltd., Seoul (KR)

( * ) Notice: Subject to any disclaimer, the term of this patent is extended or adjusted under 35 U.S.C. 154(b) by 0 days.

(21) Appl. No.: 10/491,671

(22) PCT Filed: Apr. 30, 2003

(86) PCT No.: PCT/KR03/00874

§ 371 (c)(1),
(2), (4) Date: Apr. 1, 2004

(87) PCT Pub. No.: WO03/092831

PCT Pub. Date: Nov. 13, 2003

(65) Prior Publication Data

US 2004/0262872 A1 Dec. 30, 2004

(30) Foreign Application Priority Data

May 1, 2002 (KR) ..... 10-2002-0023890
Apr. 23, 2003 (KR) ..... 10-2003-0025663

(51) Int. Cl.
*A63C 17/04* (2006.01)

(52) U.S. Cl. ..... 280/87.042; 280/87.021; 280/87.041

(58) Field of Classification Search ..... 280/87.042, 280/11.28, 11.25, 11.27, 87.01, 87.021, 87.041, 280/268, 271; 16/18 A; 301/5.7
See application file for complete search history.

(56) References Cited

U.S. PATENT DOCUMENTS 3,399,904 A * 9/1968 Schinke ..... 280/87.042
4,076,267 A 2/1978 Lipscomb
4,082,306 A * 4/1978 Sheldon ..... 280/87.042
4,093,252 A 6/1978 Rue
4,451,055 A 5/1984 Lee
5,098,087 A 3/1992 Matile et al.
5,347,681 A 9/1994 Wattron et al.
5,458,351 A * 10/1995 Yu ..... 280/87.042
5,492,345 A 2/1996 Kruczek
5,540,455 A 7/1996 Chambers
5,984,328 A * 11/1999 Tipton ..... 280/87.042
6,193,249 B1 * 2/2001 Buscaglia ..... 280/87.042
6,206,389 B1 * 3/2001 Yagi ..... 280/87.042
6,338,494 B1 * 1/2002 Killian ..... 280/87.042

(Continued)

FOREIGN PATENT DOCUMENTS

GB 2 318 519 A 4/1998

(Continued)

OTHER PUBLICATIONS

International Search Report PCT/KR03/00874 dated Sep. 18, 2003 (2 pages).

*Primary Examiner*—J. Allen Shriver
(74) *Attorney, Agent, or Firm*—Morgan & Finnegan LLP

(57) ABSTRACT

A skateboard having a front board, a rear board, a connecting element which interconnects the front board and the rear board in a spaced relationship, at least one direction-caster mounted on the underside of each of the front board and the rear board; and the connecting element comprises an elastic member so that the connecting element can be elastically twisted by application of at least one of a twisting or bending force and restores to its original shape when the force is removed.

12 Claims, 7 Drawing Sheets

U.S. PATENT DOCUMENTS

| | | | | |
|---|---|---|---|---|
| 6,419,249 | B1 * | 7/2002 | Chen | 280/87.042 |
| 6,428,022 | B1 * | 8/2002 | Namiki | 280/87.042 |
| 6,481,724 | B1 * | 11/2002 | Whipp | 280/7.13 |
| 2002/0067015 | A1 * | 6/2002 | Tierney et al. | 280/87.042 |
| 2002/0149166 | A1 * | 10/2002 | Potter | 280/87.042 |
| 2002/0195788 | A1 * | 12/2002 | Tierney et al. | 280/87.042 |
| 2004/0021281 | A1 * | 2/2004 | Stephens, Jr. | 280/87.042 |

FOREIGN PATENT DOCUMENTS

| | | |
|---|---|---|
| JP | 01-117385 | 8/1989 |
| KR | 2001-110239 | 12/2001 |

* cited by examiner

SKATEBOARD WITH DIRECTION-CASTER

FIELD OF THE INVENTION

The present invention relates to a skateboard which comprises two separate boards(11,21) each of which has a direction-caster(13,23) and a connecting element(40) for holding the boards(11,21) at its both ends.

With this skateboard, the rider can easily turn and accelerate the skateboard by twisting the boards(11,21).

BACKGROUND ART

As it can be seen in FIG. 7*a,* conventional skateboard comprises an oval plate(111) and two wheel-sets(113,123) which are mounted on the underside of the plate(111), each of the wheel-sets carries two wheels. With this configuration, the conventional skateboard can be accelerated by the rider's stamping onto the ground and it can be steered to the right or left direction by the rider's leaning to one side or the other side of the plate(111). As it can be seen in FIG. 7*b,* a conventional caster(130) comprises a wheel support(134), roller arm(135) and a roller(136). Such a conventional caster(130) is generally used as front wheel in a handcart because it easily changes its rolling direction by application of a minimal turning force by the user.

However, without the rider's stamping onto the ground, the conventional skateboard cannot be accelerated or can be accelerated only by an extremely skillful rider.

Besides, there is another problem that the conventional skateboard cannot be tilted much for the right or left turn because the plate(111) touches the wheel of the wheel-set when the plate(111) is tilted more than a specific angle. With this reason, the conventional skateboard can be steered to a relatively small degree, so that it is not possible to change the direction of the skateboard for making a turn within a small turning radius.

Therefore, it is needed and is the objective of this invention to provide a skateboard which is much more steerable than the conventional skateboard and which can be accelerated without the rider's stamping onto the ground.

DISCLOSURE OF THE INVENTION

In order to achieve the objects above, there is provided a skateboard which has a front board, a rear board and a connecting element which interconnects the two boards in a spaced relationship, the skateboard comprising:

one or more than one direction-caster which is mounted on the underside of the plate of at least one of the front board and the rear board; and the connecting element which includes an elastic member so that the connecting element can be elastically twisted or bent when it receives twisting force or bending force and it can be restored to its original shape when the force is removed.

In accordance with the present invention, the front board may have one or more than one direction-caster and the rear board may have one or more than one fixed roller set.

In accordance with the present invention, the connecting element may be a twist-pipe which has elastic material in it.

In accordance with the present invention, the connecting element may comprise the twist-pipe and two elastic members which are provided parallel to the twist-pipe at both sides of the twist-pipe and are connected to the front board and the rear board at each of their both ends.

In accordance with an aspect of the present invention, there is provided a skating board which has a front board, a rear board and a connecting element which interconnects the two boards in a spaced relationship, wherein at least one of the front board and the rear board has one or more than one direction-caster skate blade which is mounted on the underside of the plate of the front board and the rear board, the connecting element includes an elastic member so that it can be elastically twisted or bent when it receives twisting force or bending force and it can be restored to its original shape when the force is removed.

MODES FOR CARRYING OUT THE INVENTION

Hereinafter, the present invention will be described in more detail with reference to the following Examples. However, these examples are given for the purpose of illustration and are not to be construed as limiting the scope of the invention.

EXAMPLES

Figure 1:
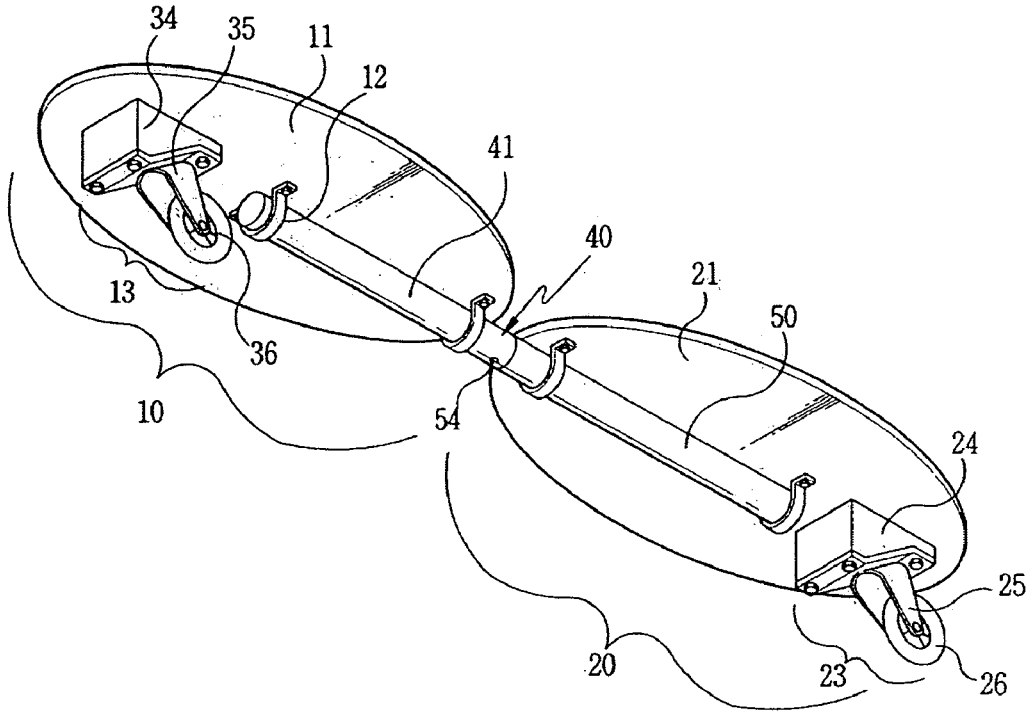
FIG. 1 is a perspective view illustrating the shape of a skateboard according to a first embodiment of the present invention.

As it can be seen in FIG. 1, the skateboard with direction-casters according to the present invention comprises two boards, which are the front board (10) and the rear board(20) respectively, and a twist-pipe(40) which interconnects the two boards(10,20) in a spaced relationship.

The board(10or20) comprises a plate(11or21), a direction-caster(13or23) which is mounted on the underside of the plate(11or21) and fastening devices(12) which tightly fasten the board(10or20) to the twist-pipe(40).

Figure 2:
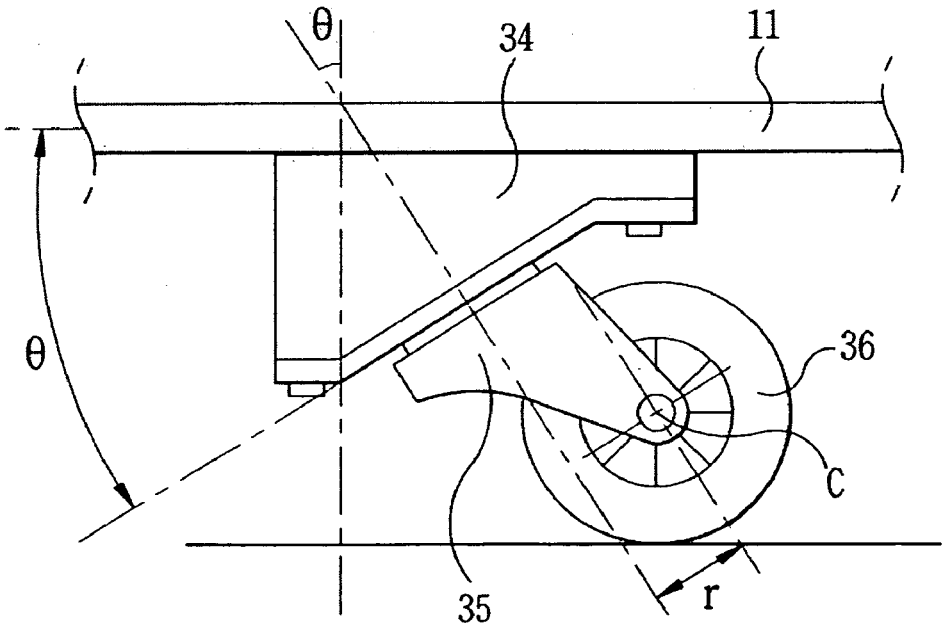
FIG. 2 is an exploded side view of the direction-caster in FIG. 1.

As it can be seen in FIG. 2, the direction-caster comprises a wheel support(34) attached to the plate, a roller arm(35) which is pivotably connected to the wheel support(34) and a roller(36) which is rotatably connected to the free-end parts of the roller arm(35). The wheel support(34) has the shape of a wedge, so that an acute angle is formed between the contact surface of the wheel support(34) and the plate (11) and the facing surface of the wheel support(34) and the roller arm(35).

Figure 3A:
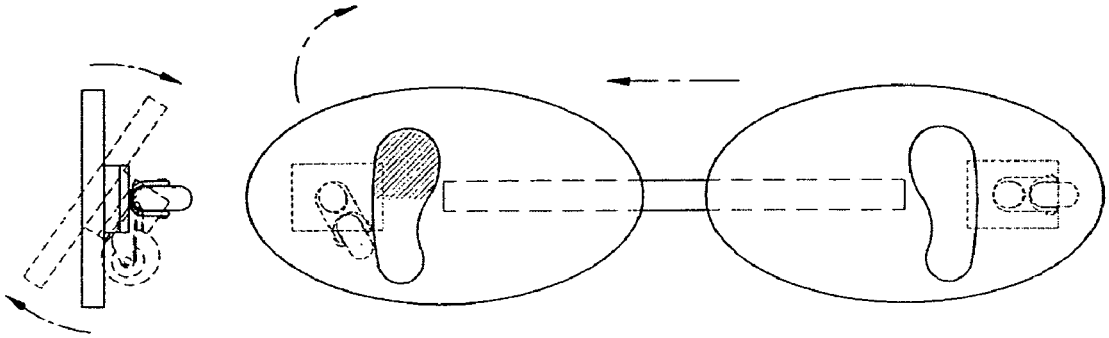
FIGS. 3*a,* 3*b,* 3*c* are plan views showing how to steer the skateboard in FIG. 1.

With this skateboard having the direction-casters(13,23), as can be seen in FIG. 3*a,* if the rider leans the front board(10) to its right side with respect to the advancing direction of the skateboard, the roller arm(35) of the front direction-caster(13) turns to the left side and the roller(36) rolls to the right direction with respect to the advancing direction, so that the rider can turn to the right direction.

Figure 3B:
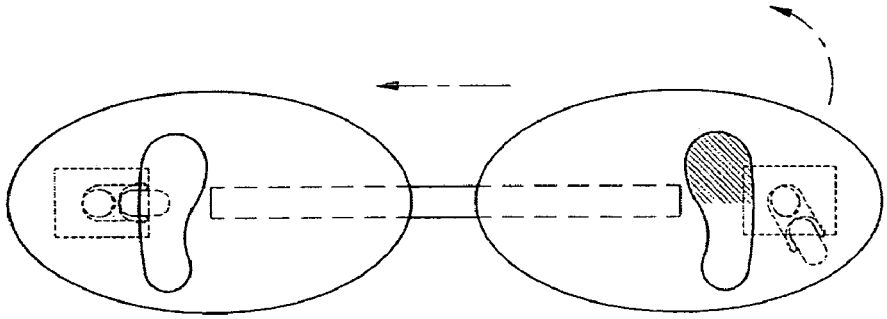
FIG. 3*d* is a plan view showing how to generate the driving force of the skateboard in FIG. 1.

Alternatively, as can be seen in FIG. 3*b,* if the rider leans the rear board(20) on its right side with respect to the advancing direction, the roller arm(25) of the rear direction-caster(23) turns to the left side and the roller(26) rolls to the right with respect to the advancing direction, so that the rear board(20) turns to the right, with the result that the rider can turn to the left direction.

Figure 3C:
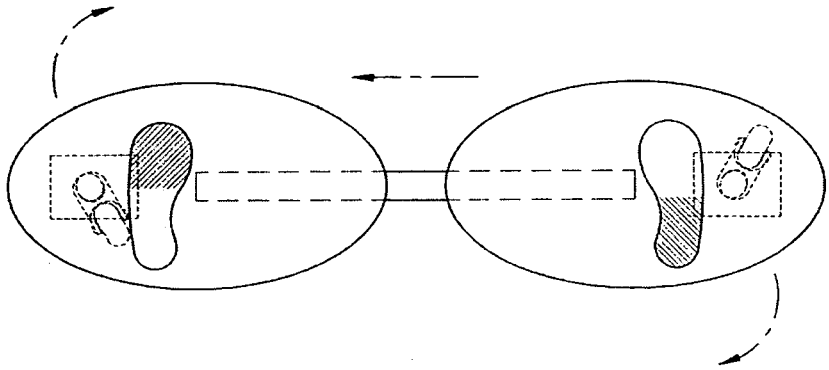

Combining said two effects, as can be seen in FIG. 3*c,* when the rider leans the front board(10) to its right side and the rear board(20) to its left side with respect to the advancing direction, the rider can turn to the right direction within a small turning radius. In addition, if the rider leans the both boards(10,20) to the same lateral side with respect to the advancing direction, he/she can advance in that direction with the both boards(10,20) advancing parallely.

Figure 3D:
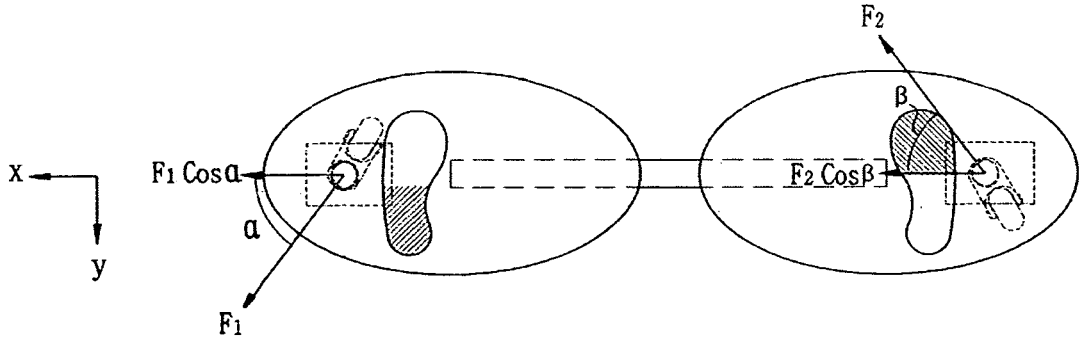

The mechanics for generating the driving force is shown in FIG. 3*d,* where the rider makes twisting motion to the left direction with respect to the advancing direction. As the rider twists to the left direction, the front board(10) is biased to +y direction and the rear board(20) is biased to −y direction, so that the direction-casters(13,23) make rolling angles($\alpha$,$\beta$) with respect to the advancing direction proportional to the magnitude of the biasing forces received by the boards(10,20). And because of the characteristics of the wedge shape of the wheel supports(34,24) which is the components of the direction-casters(13,23), forces(F1,F2) are generated in the rolling direction of the direction-casters (13,23). So the horizontal component forces(F1 Cos $\alpha$, F2 Cos $\beta$) of the forces(F1,F2) generate the driving forces which accelerate the skateboard. As a result, with the skateboard having direction-casters, there is no need for the rider to stamp on the ground for generating the driving force, instead, he/she needs only to twist his/her body right and left without moving his/her feet. And it can be seen in FIG. 3*d,* the vertical components of the F1 and F2 (F1 Sin $\alpha$, F2 Sin $\beta$) make a moment M to make the skateboard rotate around its center of gravity.

Figure 4A:
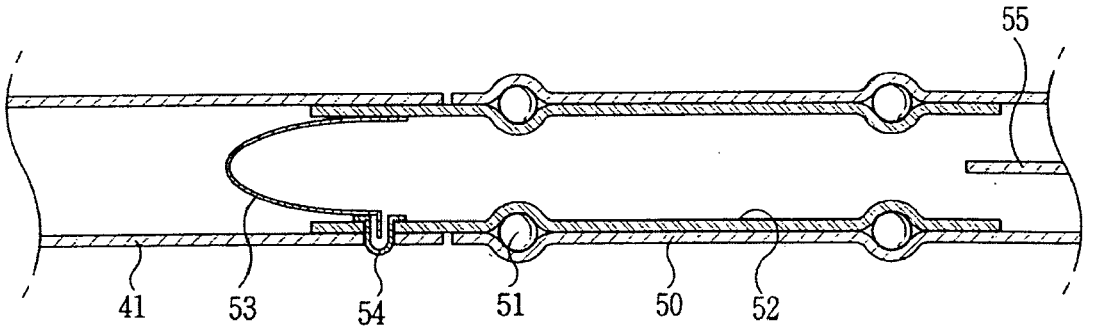
FIG. 4*a* is a cross section view of the twist-pipe in FIG. 1.

As shown in FIG. 4*a,* the twist-pipe(40) comprises the front pipe(41), the rear pipe(50), the inner pipe(52) which is fixedly held in the rear pipe(50) by ball bearing(51) so that it can rotate with respect to the rear pipe(50) but cannot be separated from the rear pipe(50), and the spring lock(53,54) which is fixed in the inner pipe(52) and connects the inner pipe(52) with the front pipe(41) to make the two pipes(52, 41) rotate together.

Figure 4B:
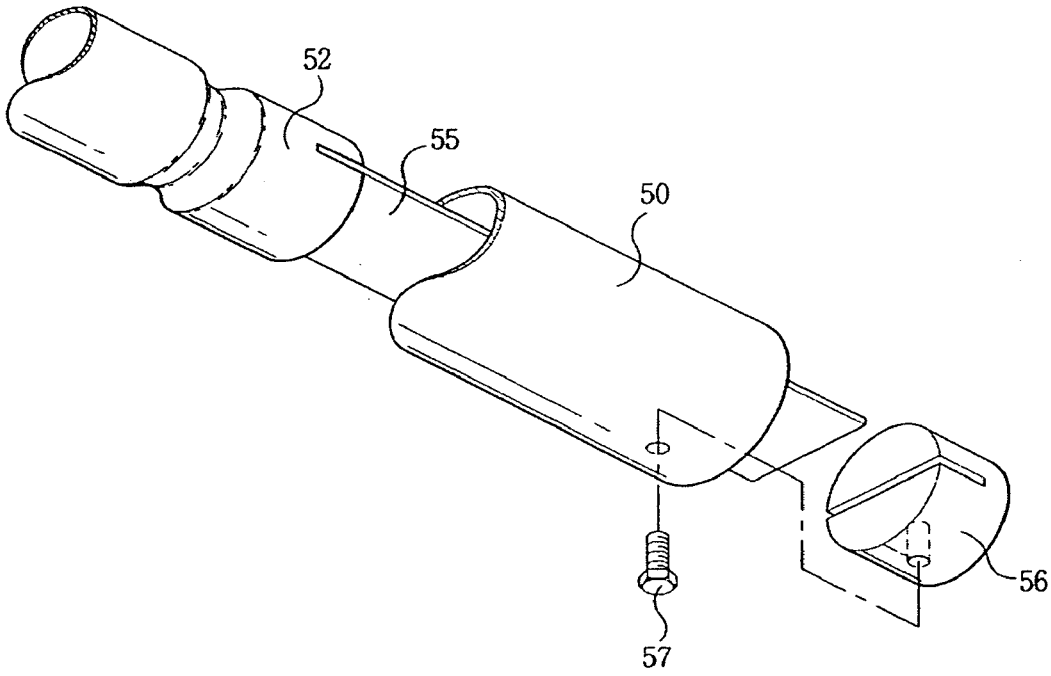
FIG. 4*b* is a perspective view showing the installation of the plate spring in FIG. 4*a;*

A plate spring(55), which will be installed in the rear pipe(50), is shown in FIG. 4*b.* The plate spring(55) is combined to the inner pipe(52) at one end and combined to the rear pipe(50) at the other end by the holders(56), so that the plate spring(55) is elastically twisted by the rotation of the front pipe(41), relative to the rear pipe(50), caused by the rider's twisting force. At this time, the plate spring(55) provides restoring force when the twisting force is removed. With said configuration, the twist-pipe(40), with the plate spring(55) in it, enables the rider to safely maintain his/her balance by its restoring force generated by the plate spring (55) when the rider twists the front and rear boards(10,20) right and left to make a turn or to generate driving force while riding the skateboard of the present invention.

Besides, the two boards(10,20) can be separated by pushing the button(54) of the spring lock(53,54), so it is convenient for the rider to keep and carry the skateboard.

In addition, two or more direction-casters(13,23), which are mounted on the underside of the plates(11,21), can be installed so as to be aligned along a longitudinal axis of the plates(11,21), or so as to be parallel in a side-by-side arrangement. With the longitudinal or the parallel configuration, the skateboard has a relatively larger turning radius, but it ensures greater safety.

Figure 5A:
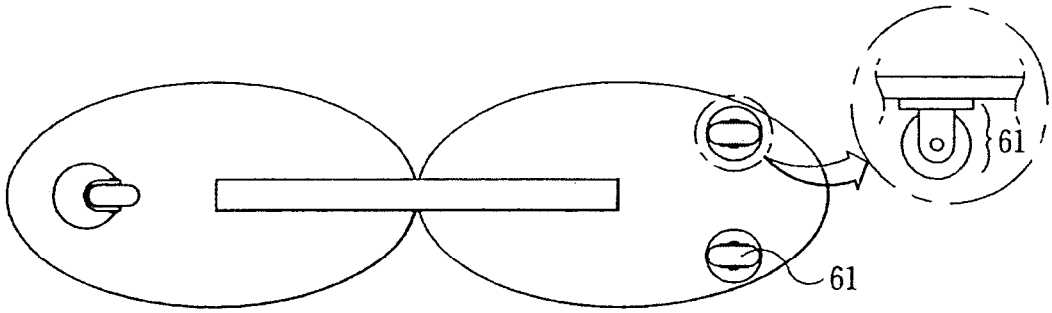
FIG. 5*a* is the outline of a skateboard according to a second embodiment of the present invention.

As it can be seen in FIG. 5*a,* the direction-caster(13) is adopted in the front board(10), but one or more fixed roller sets(61), in which the roller cannot be rotated on the axis of the roller arm, are adopted in the rear board(20). With this configuration, the turning of the skateboard can be effected only by the front board(10). So, in consideration of safety, this skateboard can be used for young children.

Figure 5B:
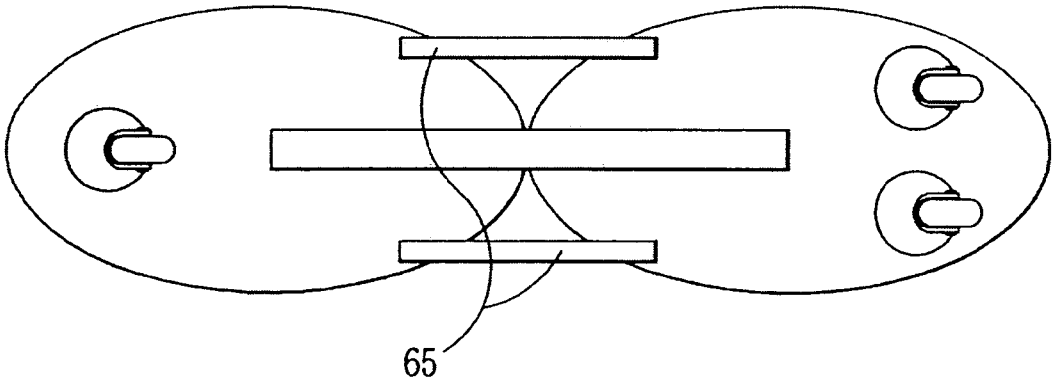
FIG. 5*b* is the outlines of a skateboard according to a third embodiment of the present invention.

In FIG. 5*b,* the twist-pipe(40) is not equipped with the plate spring device(55,56,57), but there are two flexible rubber members(65) which are parallel to the twist-pipe(40) at both side of the twist-pipe(40). The two flexible rubber members(65) are connected at each of their one ends to the front board(10) and at their other ends to the rear board(20). The restoring force can be obtained by these flexible rubber members(65) when the twist-pipe(40) is twisted.

Figure 6:
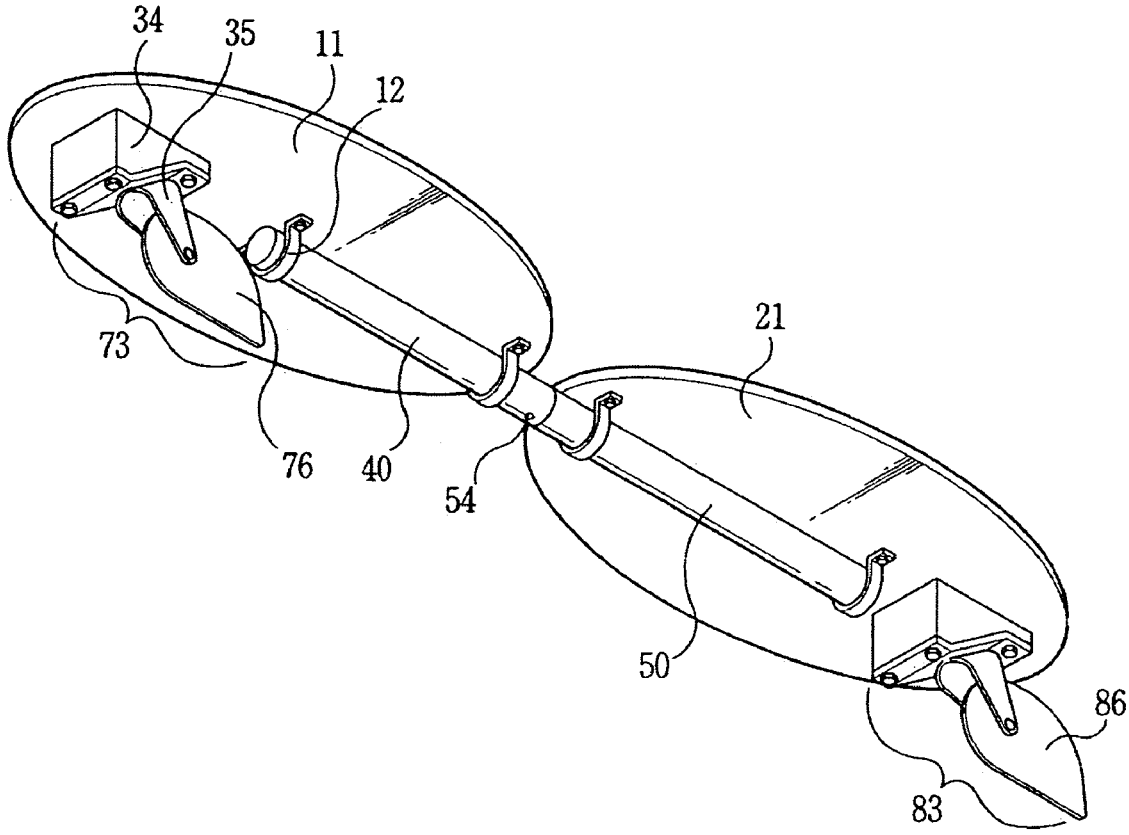
FIG. 6 is a perspective view of a skating board skateboard according to a fourth embodiment of the present invention.
Figure 7A:
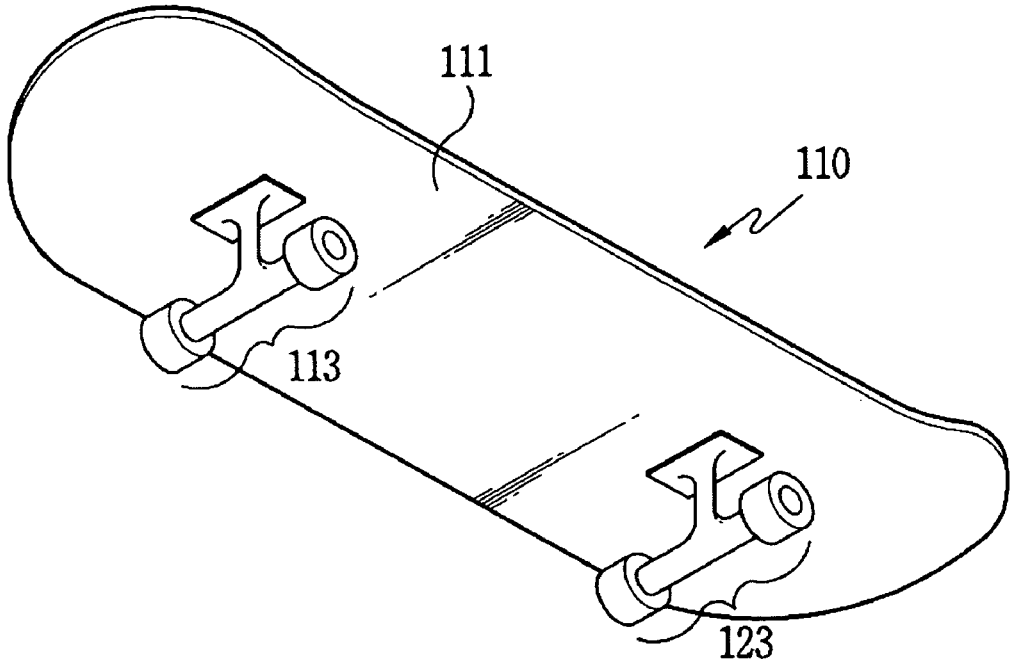
FIG. 7a (PRIOR ART)
FIG. 7*a* is a perspective view illustrating the shape of a conventional skateboard.
Figure 7B:
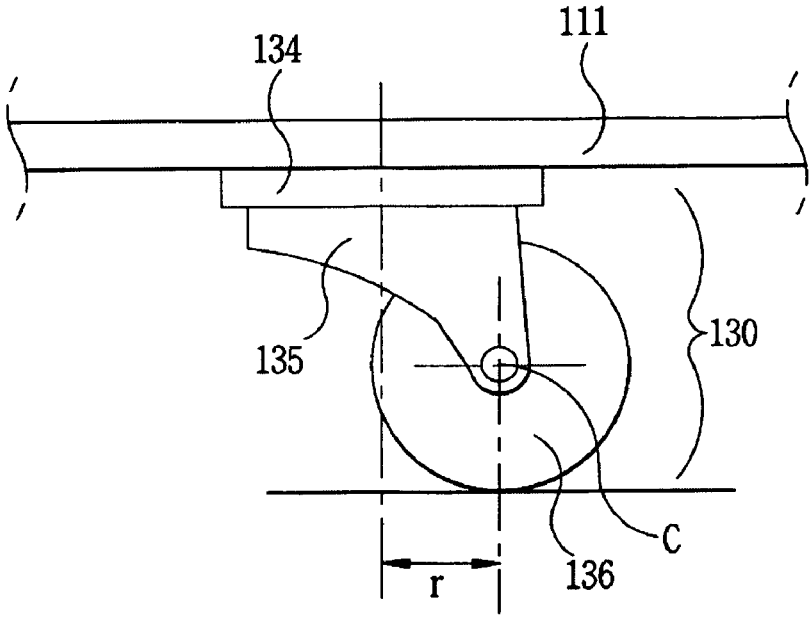
FIG. 7b (PRIOR ART)
FIG. 7*b* is a side view of a conventional caster.

And from the skateboard above, it is conceivable to invent a skating board, as can be seen in FIG. 6, provided with direction-caster skate blades(73,83) that have blades(76,86) instead of the rollers(36,26) in the direction-casters(13,23) in FIG. 1. The skating board is used on ice.

The invention claimed is:

1. A skateboard comprising:

a front board, a rear board, a connecting element which interconnects the front board and the rear board in a spaced relationship, at least one direction-caster, that is freely movable about its pivot axis, mounted on the underside of each of the front board and the rear board so that the pivot axis of each is inclined at an acute angle with respect to the front and rear boards with a common orientation; and wherein the connecting element comprises an elastic member so that the connecting element can be moved by application of at least one of a twisting or bending force and elastically restores to its original shape when the force is removed.

2. A skateboard according to claim 1, wherein the front board has at least one direction-caster and the rear board has at least one fixed roller set.

3. A skateboard according to claim 1, wherein the connecting element is a twist-pipe having an elastic matter therein.

4. A skateboard according to claim 1, wherein the connecting element comprises:

a twist-pipe and two elastic members connected at their one ends to the front board and at their other ends to the rear board, wherein the two elastic members are arranged substantially parallel to each other.

5. The skateboard of claim 1 wherein the at least one direction-caster comprises a skate blade.

6. A skateboard according to claim 1 wherein the at least one direction-caster comprises at least one wheel.

7. A skateboard according to claim 1, wherein the connecting element comprises:

a twist-pipe and two elastic members connected at their one ends to the front board and at their other ends to the rear board, and wherein the twist pipe lies between the two elastic members.

8. A skateboard according to claim 7, wherein the twist-pipe and two elastic members are substantially parallel to each other.

9. A skateboard according to claim 1, wherein the direction-caster comprises:

a wheel support attached to the board having the shape of a wedge, a roller arm pivotably connected to the wheel support, and a roller rotatably connected to a free-end part of the roller arm.

10. A skateboard comprising:

a front board, a rear board, a connecting element which interconnects the front board and the rear board in a spaced relationship, at least one direction-caster mounted on the underside of each of the front board and the rear board and oriented forward at an acute angle defined by inclination of a pivot axis of the at least one direction caster relative to at least one of the first board or second board; and wherein the connecting element comprises a twist element which can be freely twisted by application of twisting force.

11. A skateboard according to claim 10, wherein the twist element is a twist-pipe.

12. A skateboard according to claim 10, wherein the direction-caster comprises:

a wheel support attached to the board having the shape of a wedge, a roller arm pivotably connected to the wheel support, and a roller rotatably connected to a free-end part of the roller arm.

* * * * *